United States Patent [19]

Goshima et al.

[11] 4,110,029

[45] Aug. 29, 1978

[54] LIQUID DEVELOPER FOR AN ELECTROSTATIC COPYING DEVICE

[75] Inventors: Yoshitomo Goshima, Yokohama; Hiroyuki Hattori, Mitaka; Shiro Komaba, Kawasaki; Kazumi Umezawa, Yokohama, all of Japan

[73] Assignee: Canon Kabushiki Kaisha, Tokyo, Japan

[21] Appl. No.: 585,602

[22] Filed: Jun. 10, 1975

Related U.S. Application Data

[62] Division of Ser. No. 509,744, Sep. 26, 1974, Pat. No. 3,957,368.

[30] Foreign Application Priority Data

| | | | |
|---|---|---|---|
| Sep. 27, 1973 | [JP] | Japan | 48-108677 |
| Oct. 1, 1973 | [JP] | Japan | 48-111249 |
| Nov. 30, 1973 | [JP] | Japan | 48-135155 |
| Dec. 13, 1973 | [JP] | Japan | 48-140956 |
| Jan. 8, 1974 | [JP] | Japan | 49-5503 |
| Jan. 8, 1974 | [JP] | Japan | 49-5504 |
| Feb. 12, 1974 | [JP] | Japan | 49-16988 |
| Oct. 5, 1973 | [JP] | Japan | 48-116829[U] |
| Oct. 5, 1973 | [JP] | Japan | 48-116830[U] |
| Dec. 20, 1973 | [JP] | Japan | 48-146414[U] |

[51] Int. Cl.[2] ..... G03G 15/10

[52] U.S. Cl. ..... 355/10; 118/DIG. 23; 118/659; 222/109; 354/324

[58] Field of Search ..... 354/317, 324, 303, 304, 354/305, 323; 355/10; 118/DIG. 23, 659, 662; 222/109, 538

[56] References Cited

U.S. PATENT DOCUMENTS

| | | | |
|---|---|---|---|
| 625,384 | 5/1899 | Dewhurst et al. | 222/538 |
| 3,137,225 | 6/1964 | Cuthbert | 354/324 X |
| 3,334,613 | 8/1967 | Young | 355/10 X |
| 3,368,525 | 2/1968 | Sacre | 118/662 |
| 3,650,196 | 3/1972 | Hosoe et al. | 354/324 |
| 3,683,852 | 8/1972 | Yamaguchi et al. | 355/10 X |
| 3,704,662 | 12/1972 | Johnson et al. | 354/324 |
| 3,722,559 | 3/1973 | Hoffman | 355/10 X |
| 3,733,124 | 5/1973 | Tanaka et al. | 355/10 |
| 3,752,119 | 8/1973 | Matkan | 355/10 X |
| 3,758,204 | 9/1973 | Mochizuki | 355/10 |
| 3,991,709 | 11/1976 | Sato et al. | 355/10 X |

FOREIGN PATENT DOCUMENTS

| | | | |
|---|---|---|---|
| 2,233,628 | 2/1973 | Fed. Rep. of Germany | 355/10 |

*Primary Examiner*—Fred L. Braun

*Attorney, Agent, or Firm*—Fitzpatrick, Cella, Harper & Scinto

[57] ABSTRACT

In an electrostatic copying machine which includes a member for bearing a latent image and a developing device. The developing device includes a member for applying developer liquid to the image bearing member, a container for holding developer liquid, a pump in the container, a supply pipe from the container to the applying member, a return pipe from the applying member to the container, and a filter in the return pipe. The filter has an impinging portion angularly disposed with respect to the flow of developer liquid and disposed above the surface of the developer liquid in the container during pumping and a toner accumulating portion which is immersed in the developer liquid in the container at least when the pump is not operating to soften and dispense any coagulated toner particles accumulated thereon.

16 Claims, 20 Drawing Figures

LIQUID DEVELOPER FOR AN ELECTROSTATIC COPYING DEVICE

This is a division, of application Ser. No. 509,744, filed 9/26/74 now U.S. Pat. No. 3,957,368, Yoshitomo Goshima, et al, for: "COPYING APPARATUS".

BACKGROUND OF THE INVENTION

1. Field of the Invention

This invention relates to a convenient copying machine and more particularly to a copying apparatus including a novel and convenient arrangement for developing with a liquid developer.

2. Description of the Prior Art

Copying machines may be of the liquid or the dry type. However, liquid development is superior to dry development in that it is higher in developing efficiency and can provide better image reproduction. On the other hand, liquid development is delicate in developing action and therefore, cumbersome procedures are required in construction of the portion in which the photosensitive medium is contacted by developing liquid, and maintenance of the toner density of the liquid and the circulation system therefor as well as periodic servicing or inspection is imperative.

Also, in the electrophotographic art using liquid developer to develop electrostatic latent images, there has heretofore been a developing device which comprises a developer containing portion for containing the developer therein and a developing portion for developing an object to be developed on a photosensitive medium or the like, the developer containing portion and the developing portion being individually constructed with a distance therebetween. In such device, the developing portion and the developer containing portion have been connected together by pipes or other connecting means so that the developer may be supplied from the containing portion to the developing portion and collected from the latter into the former portion. For the purposes of maintenance, repairs, inspection or the like, removal of the developer containing portion or the developing portion must be done either by excepting the connecting pipes or by simultaneously removing the two portions unstably connected by the thin pipes. In the first-named case, one end of the expected pipes would interfere with the removal of the portion to be removed, and developer would even leak through the disconnected pipe end to contaminate the device. In the latter case, simultaneous removal of the two portions connected by the thin pipes is a difficult task and, even if only one of the two portions is to be removed, both portions need be removed and this is wasteful and time-consuming.

For the detection of the density of the developing liquid in the developing device of the copying machine, use has been made of a photoelectric detector means which comprises a light source or lamp and a light-sensing element. However, such photoelectric detector means simply immersed in the developing liquid may often have its detecting function reduced by toner which tends to precipitate and solidify to stick to a wall portion corresponding to the optical path of the photoelectric detector means. In another prior art arrangement wherein the photoelectric detector means is disposed outside the developer container and supply of developing liquid is effected by pumping means, when the copying machine has been stopped from operating, developing liquid rarely stays in the detector means so that the surface of a transparent member accommodating therein the light source and light-sensing element is dried to permit residual toner to stick to said surface, thus rendering accurate detection of the density of the developing liquid impossible.

SUMMARY OF THE INVENTION

It is therefore an object of the present invention to provide a copying machne which incorporates a filter designed to break up coagulated toner in a liquid developer.

It is a further object of the present invention to provide a copying apparatus which permits the developing device to be taken in and out of the machine body.

It is a further object of the present invention to provide a copying apparatus which readily permits removal of the developing portion or the developer containing portion without causing leakage of developer.

It is a further object of the present invention to provide a copying apparatus having a developing liquid supply device which can remove dust or other impurities from the developing liquid.

It is a further object of the present invention to provide a copying apparatus which effects highly accurate detection of the density of developing liquid.

In the developing device, the developer container and the developing electrode portion are constructed separately and connected together by pipes and the developing electrode on is coupled to a member slidably fitted to a strut provided for reinforcement of the copying machine body, so that the developing electrode portion may be slid along the strut so as to be withdrawn outwardly from the machine body for servicing or inspection.

Further, only one end or a predetermined portion of the supply and collection pipes connecting the developer containing portion and the developing portion may be removed to provide the following connections. That is, the supply pipe of the developer containing portion may be connected to the collection port of the container (or the collection pipe of the developer containing portion may be connected to the supply port of the containing portion) and in the developing portion. one end of the collection pipe hereof may be connected to the supply port of the developing portion (or one end of the supply pipe of the developing portion may be connected to the collection port of the developing portion).

A path is provided between the portion of the developing device which develops the electrostatic latent image and the developer container to permit circulation of developing liquid therebetween. Along such path, there may be provided a member for impacting and dispersing toner masses solidified in the developing liquid. This member may serve not only to disperse toner masses but also to remove dust or other impurities in the liquid or to fully filtrate the liquid. As an example of the method of dispersing toner masses, the developing liquid in the developer container may be pumped to the developing portion, whereafter the head between the developing portion and the developer container may be utilized to cause the developing liquid to fall toward a filter formed of an aggregate of fibrous material or thin parallel metal plates or a metal netting or the like so that the impacting force of the liquid may disperse toner masses.

In the density detector device, a pumping mechanism including an impeller and a casing forming a spiral chamber is provided in the developing liquid, and the casing may have a slit-like or other opening formed in a portion thereof through which the developing liquid may be directly passed to the passage portion of photoelectric detector means.

The above and other objects and features of the present invention will be more fully apparent from the following detailed description taken in conjunction with the accompanying drawings.

DESCRIPTION OF THE PREFERRED EMBODIMENTS

Figure 1:
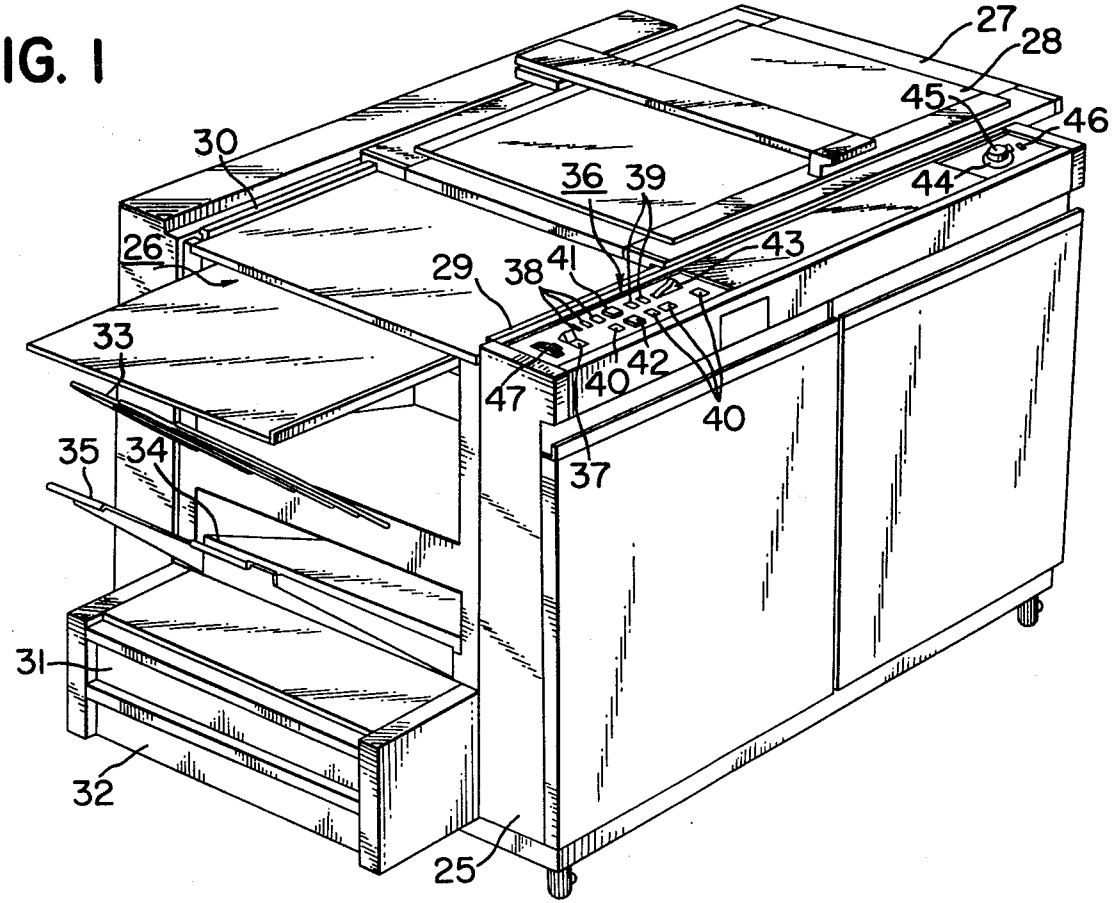
FIG. 1 is a perspective view showing an embodiment of a copying apparatus according to the present invention.

FIG. 1 is a perspective view of a copying apparatus according to the present invention, which includes an apparatus housing 25, a sheet original transport portion 26, and an original carriage 27 for carrying thereon a thick original (hereinafter referred to as "book original") and normally covered with an original keep cover 28. There are further provided original carriage guide rails 29, 30 and paper feeder beds 31,32 for carrying thereon sheets of transfer paper P, the upper and lower beds being capable of containing different sizes of transfer paper. The present apparatus further includes auxiliary trays 34,35, an operating portion 36, a main switch 37, a group of indicator lamps 38–40, a selector switch 41 for selecting the upper one of the two paper feeder beds, a selector switch 42 for selecting the lower one of the two paper feeder beds, a change-over lever 43 for effecting the change-over between a sheet original and a book original, a knob 44 for selecting the number of copies to be continuously produced, a copy button 45, an emergency stop button 46 useful during continuous copying of book original, and a throttle dial 47 for adjusting the copying speed.

Figure 2:
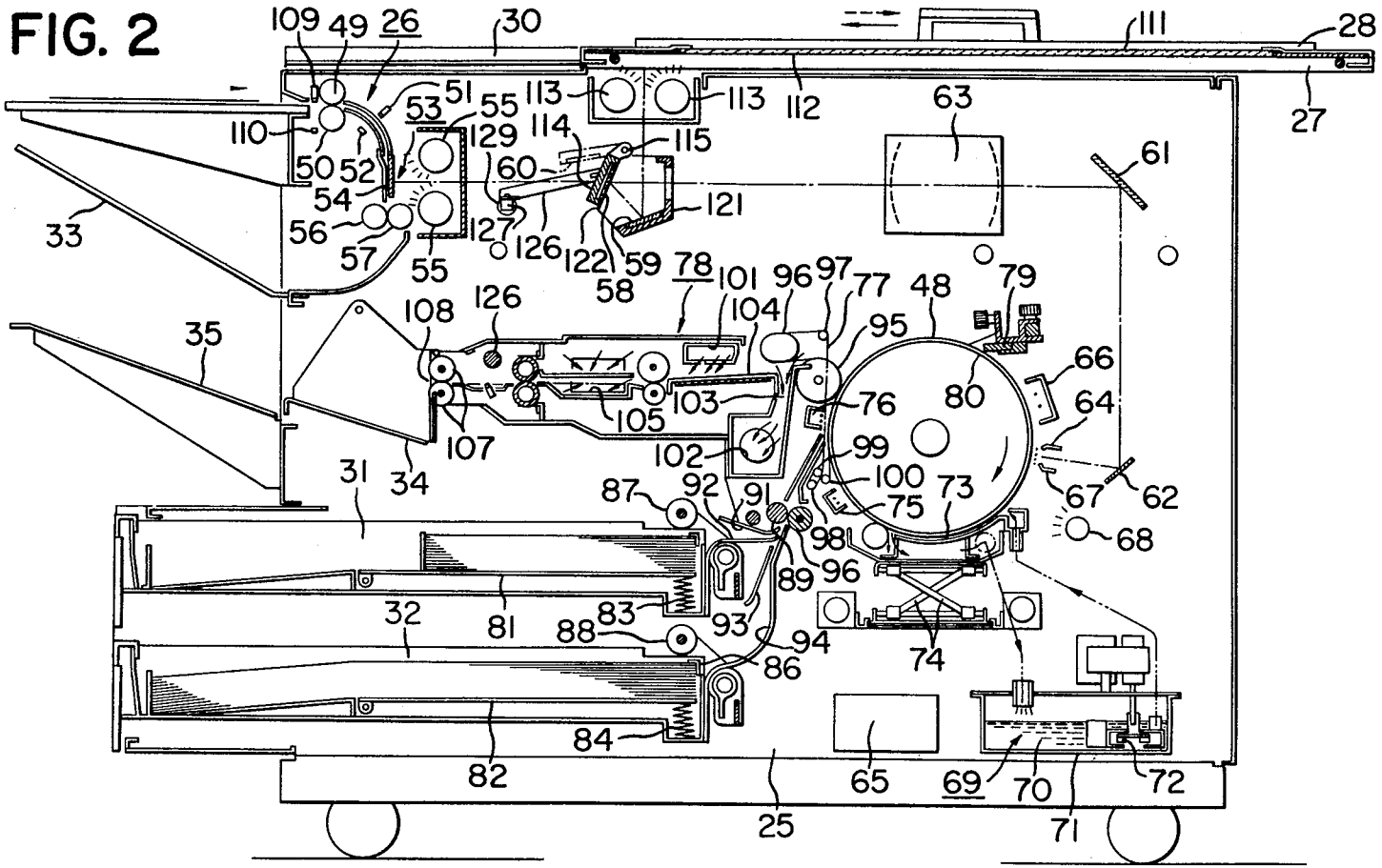
FIG. 2 is a longitudinal cross-section of the FIG. 1 apparatus.

Referring to FIG. 2, operation of such copying apparatus will now be described with respect to the copying of sheet original. As a sheet original is inserted from the left between rolls 49 and 50 of the sheet transport portion 26 which are rotating in synchronism with a drum 48, the sheet original is transported rightwardly. When the leading edge of the sheet original is detected by a lamp 51 and light-sensing element 52, the rolls 49 and 50 are temporarily stopped and accordingly the sheet original is also stopped. Next, when the photosensitive drum 48 has reached a predetermined position, a start signal for the original is produced to cause the rolls 49 and 50 to be again rotated to transport the original now downwardly in synchronism with the photosensitive drum 48, so that the original is discharged through rolls 56,57 onto a tray 33 outside the apparatus housing. During that time, the original is illuminated by two lamps 55 in an illuminating portion 53 from the right-hand side as it passes the left side of a glass plate 54. At that time, as will further be described, a single mirror 58 is in its up position as indicated by dots-and-dash line, so that the image of the original is passed through a lens 63 and via mirrors 61,62 and focused on the photosensitive drum 48 in an exposure portion 64.

Figure 4:
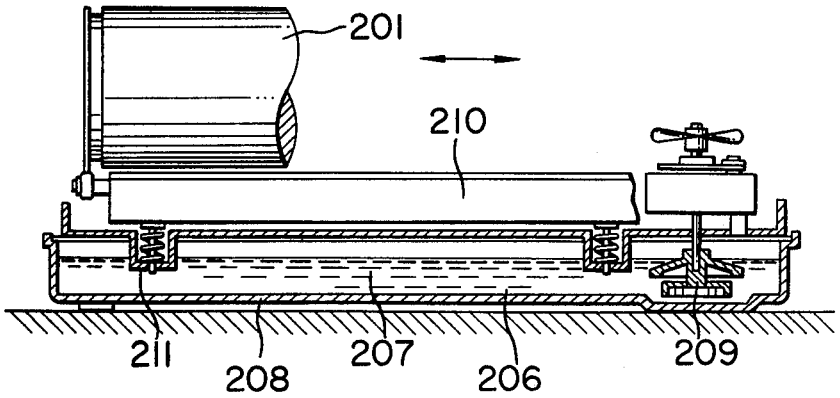
FIG. 4 is a transverse cross-section of the developing device shown in FIG. 3.

The photosensitive drum 48 comprises a photosensitive layer covered with a transparent insulating layer, and is normally rotating in clockwise direction as shown in FIG. 4. The photosensitive drum 48 is first positively charged by a primary charger 66 supplied with a positive high voltage from a high voltage source 65. When the photosensitive drum reaches the exposure portion 64, it is slit-exposed to the image from the illuminating portion 53 and simultaneously therewith, it is subjected to AC discharge from an AC discharger 67 supplied with a high alternating current from the high voltage source 65. Subsequently, the photosensitive drum is subjected to an overall exposure by a lamp 68, thereby forming an electrostatic latent image on the surface of the photosensitive drum, whereby the drum enters a developing device 69. The developing device 69 comprises a container 71 for developing liquid 70, a pump 72 for agitating and raising the developing liquid, and a developing electrode 73, which is adapted to be urged toward the photosensitive drum 48 by a linkage 74 with a slight clearance maintained with respect to the drum 48. The electrostatic latent image formed on the photosensitive drum 48 is developed into a visible image by the toner in the developing liquid 70 raised over the developing electrode 73 by the pump 72. Next, the photosensitive drum 48 is negatively charged by a post-charger 75 supplied with a negative high voltage from the high voltage source 65, whereby any excess developing liquid on the drum 48 may be squeezed out without disturbing the formed image. Subsequently, a sheet of transfer paper P delivered from the paper feeding portion is brought into intimate contact with the photosensitive drum 48 and at a transfer charger 76, the image on the drum 48 is transferred onto the transfer paper P with the aid of charging by a positive high voltage from the high voltage source 65. After the image transfer, the transfer paper P is separated from the photosensitive drum by a separator belt 77 and directed to a drying-fixing portion 78. The photosensitive drum 48 is wiped by the edge portion 80 of a blade cleaner 79 urged thereagainst to remove any residual toner and developing liquid, whereafter another cycle of operation is repeated. The developing liquid so removed by the blade cleaner 79 is directed through grooves formed on the photosensitive drum 48 at the opposite end portions thereof and is reusable for development.

The present invention has so far been described with respect to its application to the copying apparatus of the image transfer type, whereas the invention is not restricted to such type but is applicable to any copying machine, even of the direct type which uses sensitive paper, if it includes mirrors and lenses.

DEVELOPING DEVICE

Figure 3:
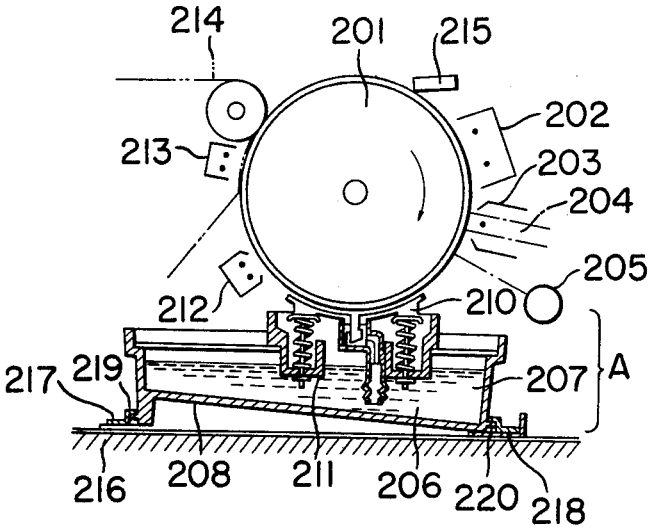
FIG. 3 is a cross-sectional view showing a developing device and photosensitive drum according to the prior art.

Referring to FIGS. 3 and 4, a photosensitive drum 201 comprises a photosensitive layer covered with a transparent insulating layer and is rotatable in clockwise direction. The photosensitive drum 201 is positively charged by a primary charger 202 and, where the drum reaches an exposure portion 204, it is slit-exposed to the image of an original and simultaneously therewith, it is subjected to AC discharge or secondary charge of the opposite polarity to that of the primary charge, by a discharger 203. Subsequently, the drum is subjected to an overall exposure by a lamp 205 to thereby form an electrostatic latent image on the surface of the photosensitive drum, whereafter the drum enters a developing device 206. The developing device 206 comprises a container 208 for developing liquid 207, a pump 209 for agitating and raising the developing liquid 207, and a developing electrode 210, which is adapted to be urged toward the photosensitive drum 201 by springs 211 with a slight clearance maintained with respect to the drum 201. The electrostatic latent image formed on the photosensitive drum 201 is developed into a visible image by the toner in the developing liquid raised over the developing electrode 210 by the pump 209.

Next, the photosensitive drum 201 is charged by a post-charger 212, whereby any excess developing liquid on the drum 201 may be squeezed out without disturbing the formed image. Subsequently, a sheet of transfer paper P delivered from a paper feeding portion is brought into intimate contact with the photosensitive drum 201 and, being charged by a transfer charger 213, the image on the photosensitive drum 201 is transferred onto the transfer paper P, whereafter the transfer paper P is directed to a drying-fixing portion by a separator belt 214. The photosensitive drum 201 is wiped by a blade cleaner 215 urged thereagainst to remove any residual toner and developing liquid, whereafter another cycle of operation is repeated.

Figure 12:
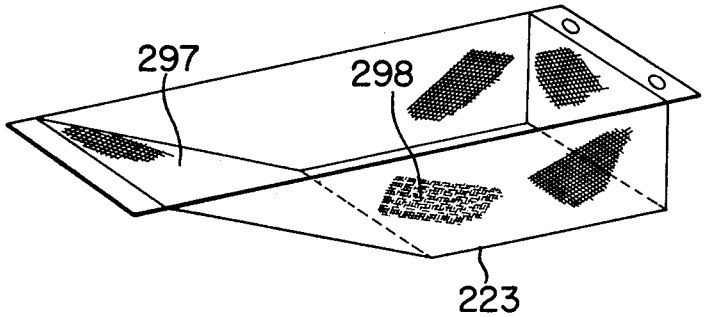
FIG. 12 is a perspective view of a filter member.

Plate-like angles 217 and 218 are attached to the bottom 216 of the copying apparatus and engaged with projections 219 and 220 of the developing device 206 and slidable in the direction of arrow in FIG. 12.

To withdraw the developing unit A from the copying apparatus body, the developing electrode 210 is lowered against the force of the springs 210 to provide a sufficient spacing between the photosensitive drum 201 and the developing electrode 210 to permit withdrawal of the developing unit, whereby the developing unit A can be slid by the cooperation between the plate-like angles 217,218 and the projections 219,220 for removal from the apparatus body.

Circulation of the developing liquid between the developing electrode and the developer container will first be described.

Figure 5:
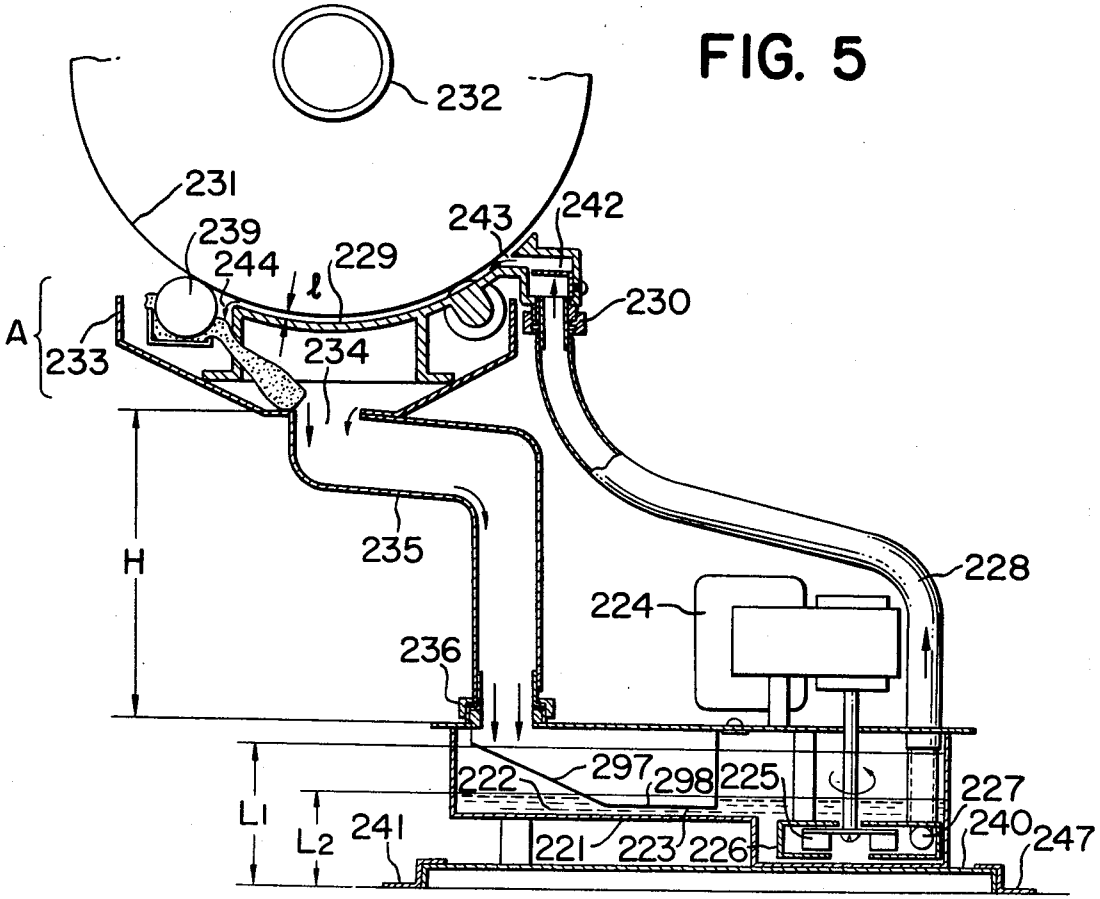
FIG. 5 is a cross-sectional view illustrating the flow of developing liquid in an embodiment of the developing device.
Figure 6:
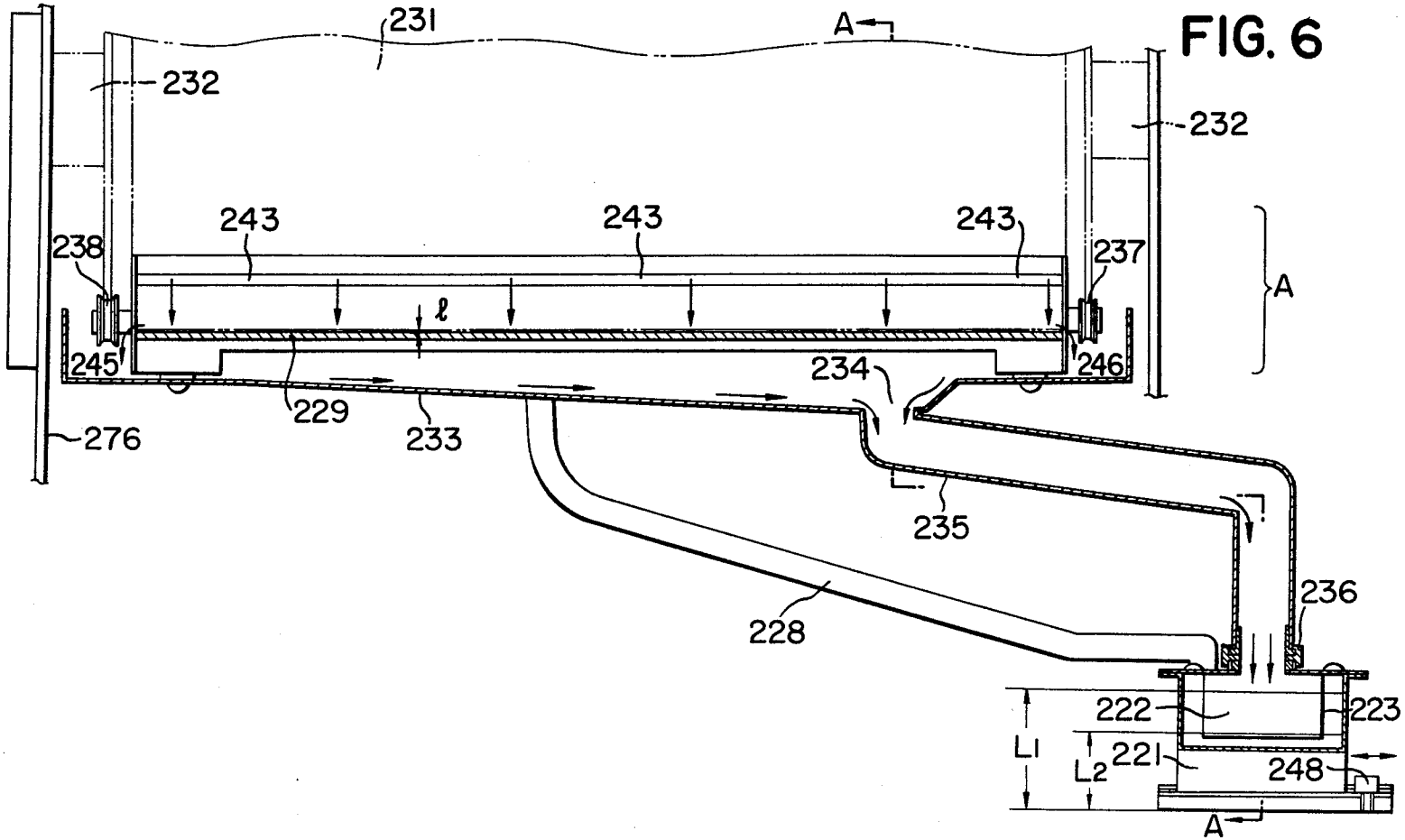
FIG. 6 is a transverse cross-section of the FIG. 5 device.

In FIG. 5, the developer container is designated by 221 and stores therein developing liquid 222, which may be filtrated through a filter 223. A motor 224 is provided with an impeller 225 for supplying the developing liquid 222 to a developing electrode portion A. A pump casing 226 has an outlet port 227 formed in a portion thereof, which outlet port is connected to a pipe 228, which has the other end releasably connected to a connector 230 of a developing electrode (which will later be described) located in the developing electrode portion A. The photosensitive drum, designated by 231, has thereon a photosensitive medium comprising a photosensitive layer covered with a transparent insulating layer, and is supported by a shaft 232. The photosensitive drum is surrounded by various means and devices for the formation of electrostatic latent image (which are similar to those shown in FIG. 3). Disposed below the photosensitive drum 231 is an arcuate developing electrode 229 which is capable of applying a developing bias voltage to the surface of the photosensitive drum with a spacing *l* with respect to the latter. A dish 233 is provided for receiving the developing liquid supplied to the developing electrode 229 to develop the electrostatic latent image, and has an outlet 234 formed in the bottom thereof at the forward end. Connected to the outlet 234 is a drain pipe 235, the other end of which is removably connected to a connector 236 of the developing container 221. The dish 233, as shown in FIGS. 5 and 6, is formed with a sloped surface for helping the developing liquid to form a stream and for preventing the toner from precipitating on the wall of the dish. Spacer rolls 237 and 238 are disposed in contact with the photosensitive drum 231 and maintain a clearance *l* between the photosensitive drum and the developing electrode 229. A fog removing roller 239 is provided to remove the fog from the formed image. The stream of the developing liquid will now be described.

When the copying apparatus is not in operation, the motor 224 is stopped and the liquid in the developer container 221 is at the level $L_1$. Thus, the filter 223 is immersed in the developing liquid to prevent the clogging of the filter which would otherwise result from solidification of toner.

Next, when the copying apparatus is operated, the motor 224 revolves in the direction of arrow, and the developing liquid is drawn into the casing 226 by the impeller 225 and passes through the pipe 228 into the developing electrode 229 to strike against a flow velocity reducing plate 242, by which the developing liquid has its flow velocity reduced and slowly passes through an opening 243 formed in the developing electrode 229 along the entire length thereof, so that the liquid fills the clearance *l* between the drum 231 and the electrode 239 to thereby develop the electrostatic latent image into a visible image due to deposition of toner particles on the latent image.

The developing liquid flowing out at the left side 244 of the fog removing roller 239 in FIG. 5 (the front and rear end faces 245 and 246 of the developing electrode 229 as viewed in FIG. 6) is received in the dish 233 and flows down along the sloped surface thereof to the outlet 235, from which the developing liquid falls through the drain pipe 235 while being given a sufficient energy by the head H. As part of the developing liquid in the developer container 221 reaches the developing electrode 229, the quantity of the developing liquid in the container 221 gradually decreases while part of the developing liquid begins to collect into the container through the drain pipe 235, thereby providing a constant liquid level at which the decrease and increase are balanced within the developer container. Such constant level is indicated by $L_2$. The filter 223 now exposes itself entirely out of the liquid, but the drops of developing liquid given a sufficient energy by the head H strike the exposed filter 223 to crush the toner on the filter and also prevent masses of toner or dust from sticking to the filter so as to ensure the filter to filtrate the developing liquid sufficiently. The developing liquid filtrated through the filter 223 forms a rapid flow in the developer container 221 and flows into the pumping portion. Thus, precipitation of toner can be prevented and sufficient agitation of the liquid can be ensured by the rapid flow.

It will thus be seen that, by constructing the developer container 221 and the developing electrode separately from each other and connecting them together by pipes, the volume of the developing liquid in the container can be selected as desired, in accordance with the intended purpose.

Description will now be made of a mechanism for withdrawing the developer container and developing electrode portion from the copying apparatus body. In FIG. 5 and 6, the angle 240 is secured to the bottom surface of the developing container 221 and engaged with angles 241 and 247 secured to the apparatus body. The angle 240 is slidable in the direction as indicated by arrow in FIG. 6. The developing container 221 is secured to the apparatus body by screws 248 and, by pulling it in the direction of arrow or rightwardly, the angles 240 and 241,247 may be disengaged to permit removal of the container from the apparatus body.

Figure 7:
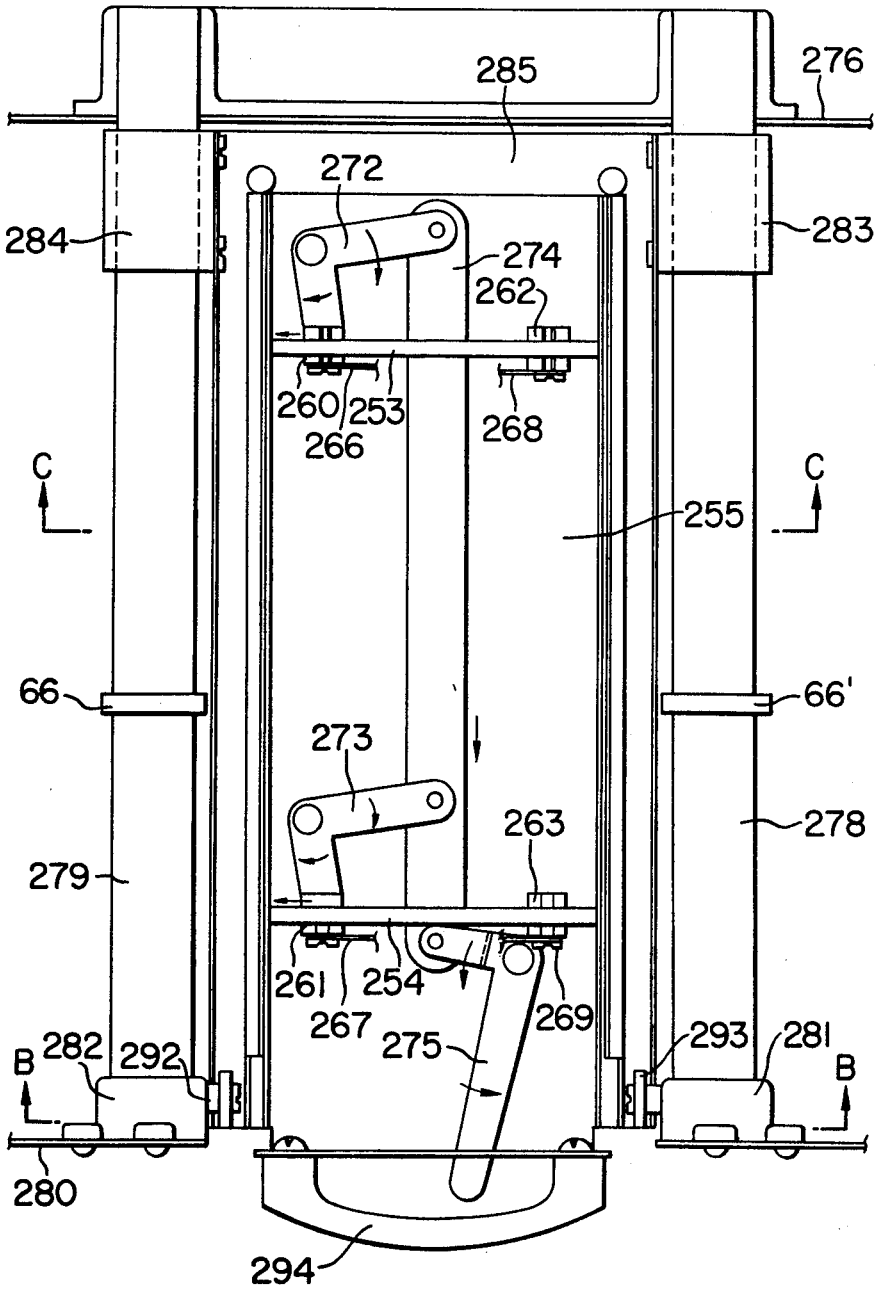
FIG. 7 is a front view of an embodiment of the lift mechanism and slide portions of the developing device.
Figure 9:
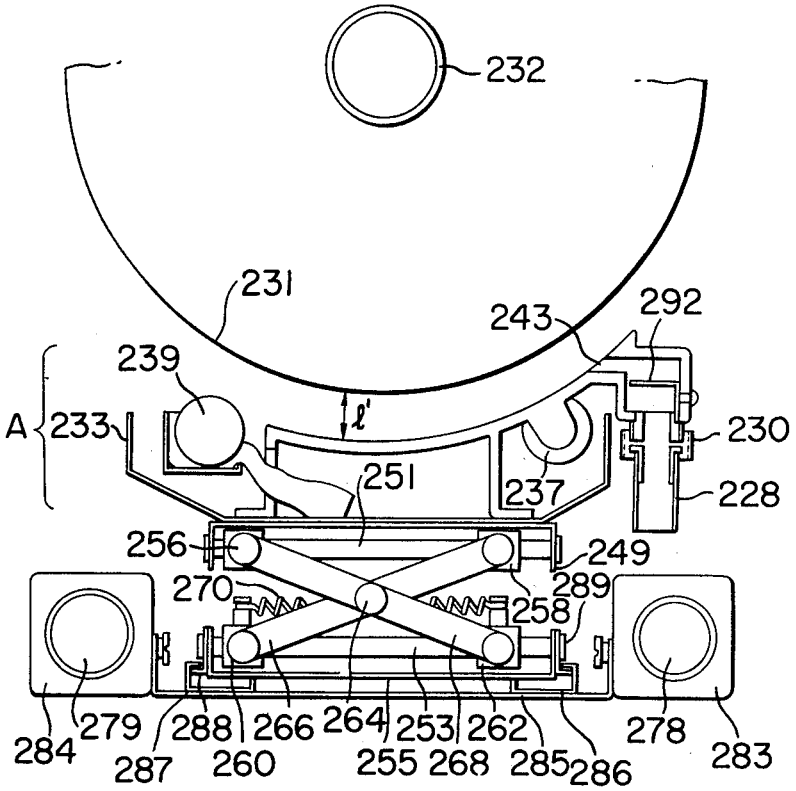
FIG. 9 is a cross-section taken along line C—C of FIG. 7.

Referring to FIGS. 7 and 9, description will now be made of the mechanism whereby a spacer roller 237 may be urged against the photosensitive drum 231 to maintain a clearance *l* between the drum and the developing electrode 229. Slide shaft mount plates 249 and 250 are secured to the bottom of the dish 233 and slide shafts 251 and 252 are secured to the mount plates. Likewise, slide shafts 253 and 254 are secured to a slide base plate 235. The slide shafts 251 and 252 have sleeves 256 and 257 slidably fitted thereon and have sleeves 258 and 259 fixed thereto. Likewise, slide shafts 253 and 254 have sleeves 260 and 261 slidably fitted thereon and have sleeves 262 and 263 fixed thereto. Links 266, 267, 268 and 269 of equal length intersect one another at the center and are caulked together for rotation about an axis. These links have their opposite ends pivotably secured to the sleeves 258, 259, 256, 257 and the sleeves 250, 261, 262, 263, respectively. Tension springs 270 and 271 extend between and are secured to the sleeves 261, 263 and 260, 262 to normally bias the links to their open position. Levers 272 and 273 are rotatably mounted on the slide base plate 255 and each have one end fitted to shafts (not shown) secured to the underside of the sleeves 260,261 and the other end fitted to a connector lever 274 which connects the levers 272 and 273 together. Likewise, a lever 275 is rotatably mounted on the slide plate 255 and has one end fitted to the connector lever 274 and the other end engaged with a stop provided on the bent portion of the slide base plate 255.

Because of the above-described construction, the sleeves 260 and 261 slidably fitted on the slide shafts 253 and 254 are rightwardly moved by the forces of the tension springs 270 and 271. With this, the sleeves 256 and 257 slidably fitted on the slide shafts 251 and 252 are also rightwardly moved by the links 266, 267, 268, 269 while rising in parallel to the slide shafts 253, 254. This also causes the developing electrode portion A secured to the slide shaft mount plate 250 to rise together until it is stopped with the spacer roller 237 urged against the photosensitive drum 231. This position is shown in FIG. 8.

To lower the developing electrode portion A, the lever 275 may be rotated counter-clockwise (the direction of arrow) to thereby cause the connector lever engaged with the lever 275 to move toward this side in FIG. 7 (the direction of arrow). This in turn causes the levers 272 and 273 engaged with the connector lever 274 to be rotated clockwise (the direction of arrow), which also causes the sleeves 261 and 262 slidably fitted on the slide shafts 253 and 254 to slide leftwardly (the direction of arrow) against the forces of the springs 270 and 271. Thereupon, the sleeves 256 and 257 slidably fitted on the slide shafts 251 and 252 are also leftwardly moved by the links 266, 267, 268, 269 while lowering in parallel to the slide shafts 253 and 254. When the photosensitive drum 231 is withdrawn along the shaft 232, the developing electrode portion A is lowered until there is provided a sufficient clearance *l'* to keep the spacer roller 237, the fog removing roller 239 and the like off the drum, whereupon the developing electrode portion A is stopped at its lowered position, against the forces of the springs 270 and 271, by the stop provided on the bent portion of the slide base plate 255.

Figure 8:
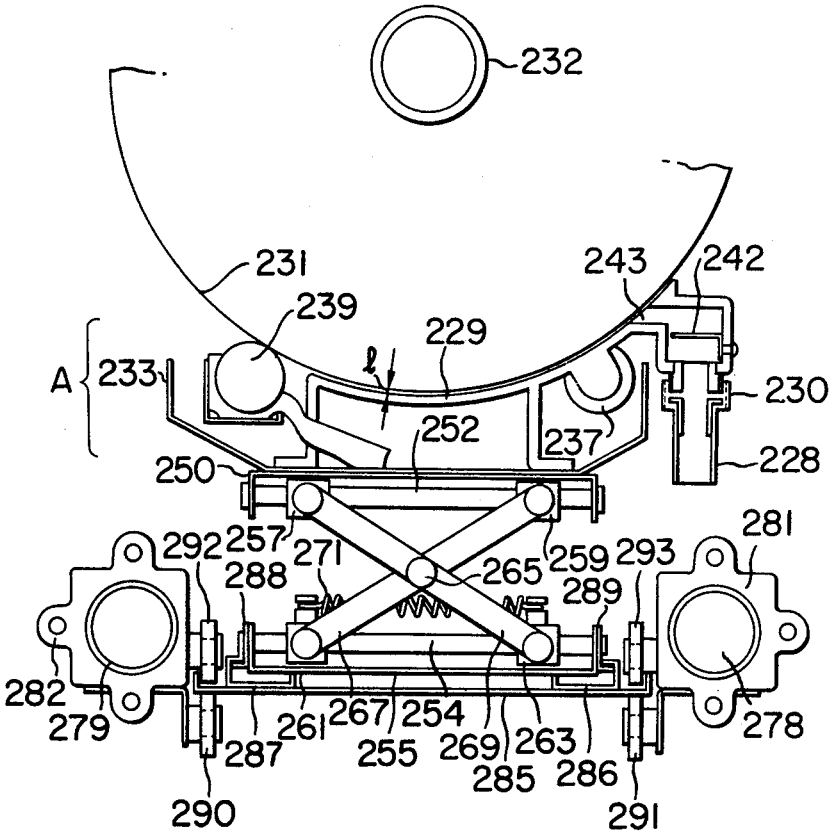
FIG. 8 is a cross-section taken along line B—B of FIG. 7.
Figure 10:
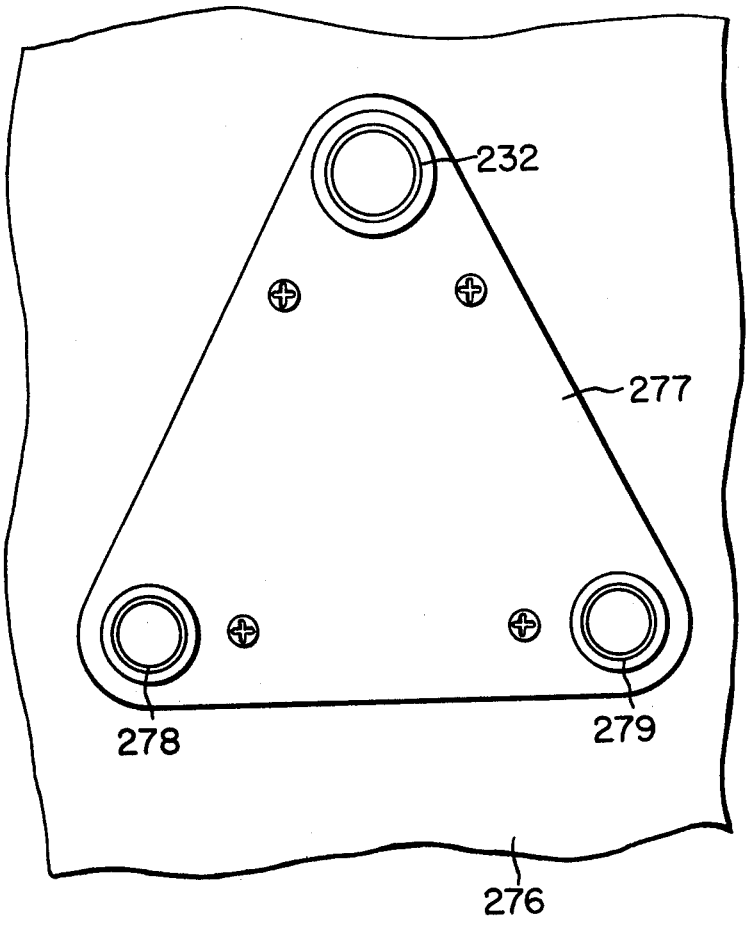
FIG. 10 is a view taken from D in FIG. 7 (or from the rear side plate).

In FIGS. 8 and 10, a rear side plate 276 has secured thereto a reinforcing casting 277 which provides reinforcement of both the rear side plate 276 and the photosensitive drum shaft 232. Further, reinforcing struts 278 and 279 also for reinforcement of the rear side plate 276 and the drum shaft 232 are secured to support castings 281 and 282 which have the opposite ends secured to the reinforcing casting 277 and a front side plate 280, respectively.

Slide castings 283 and 284 are slidably fitted to the reinforcing struts 278 and 289 and have a slide base plate 285 attached thereto. Two angles 286 and 287 are spot-welded to the upper surface of the slide base plate 285 and slidably engaged with the bent portions 288 and 289 of the slide base plate 285.

Two pairs of rollers 290,291 and 292,293 are rotatably mounted on the reinforcing strut castings 281 and 282 secured to the front side plate 280, and the slide base plate 285 is held between the rollers 291 and 293 and between the rollers 290 and 292. The slide base plate 255 is provided with a handle 294, the stops 295 and 296 are secured to the reinforcing struts 278 and 279.

Figure 11:
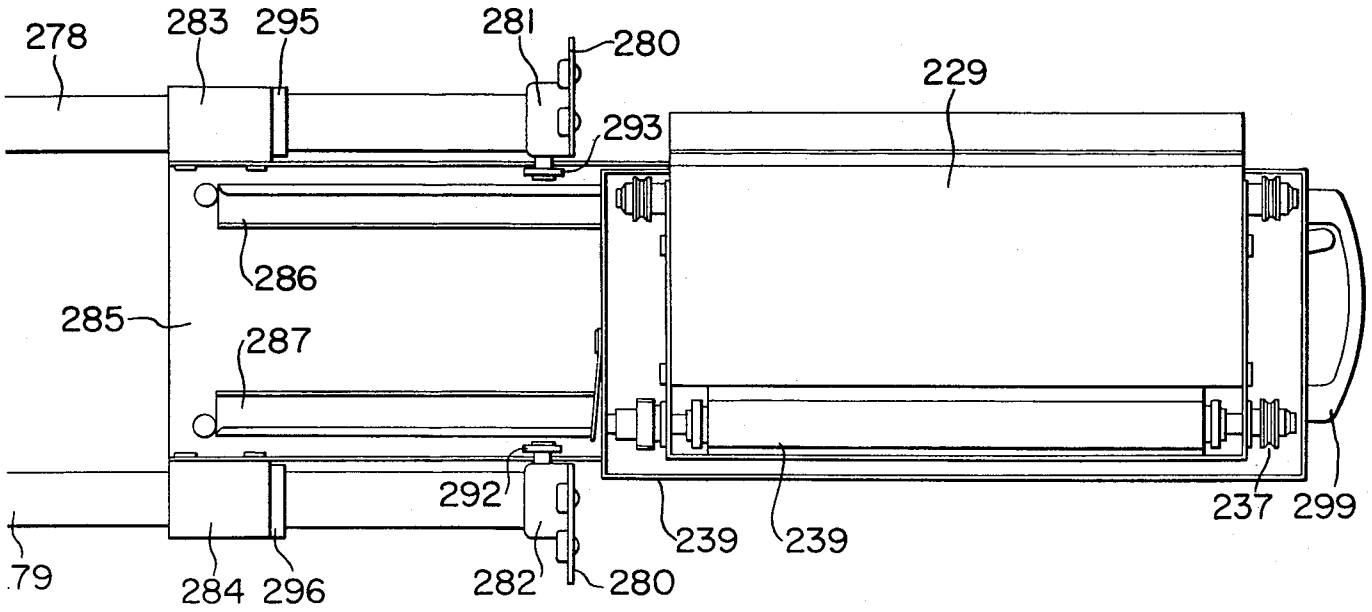
FIG. 11 is a front view of the developing device with the developing electrode portion thereof withdrawn.

In the above-described construction, to withdraw the developing electrode portion A out of the apparatus body, as described previously, the developing electrode portion A is first lowered, and then withdrawn by gripping the handle 294, whereby the slide base plate 255 slides in the engagement portions between the bent portions 288,289 and the angles 286,287 on the slide base plate 285 to come out toward this side in FIG. 7, until it is stopped on its way by a stop (not shown), whereupon the slide base plate 285 now comes out with the slide castings 283 and 284 slidably fitted to the reinforcing struts 278 and 279 (see FIG. 11). When the developing electrode portion A has come completely out of the front side plate 280, the end faces of the slide castings 283 and 284 strike the stops 295 and 296 on the reinforcing struts 278 and 279, thus coming to a halt.

It is to be noted that withdrawal of the developing electrode portion A requires the steps of loosening and removing the connector 236 of the drain pipe 235, loosening and removing the connector 230 of the pipe 228 in the course of withdrawal, and breaking the connection between the developer container 221 and the developing electrode portion A. As described above, the developer container and the developing electrode portion are constructed separately from each other and connected together by pipes so as to permit circulation of developing liquid, and a plate provided with a lift mechanism whih is capable of maintaining a constant clearance between the developing electrode portion and the photosensitive drum is slidably placed on a casting slidably fitted to two reinforcing struts which provide reinforcement of both the copying apparatus body and the photosensitive drum shaft, so that when the developing electrode portion is to be withdrawn from the apparatus body the electrode portion may first be lowered away from the photosensitive drum surface by the lift mechanism, whereafter the developing electrode portion may be pulled outwardly, whereby the plate carrying thereon the developing electrode portion and the lift mechanism is slidingly withdrawn until stopped by stops provided on the plate secured to the casting slidably fitted to the reinforcing struts, whereupon that plate may now slide along the reinforcing struts and the developing electrode portion may stop at a position projected outwardly of the apparatus body.

In such position, the developing device permits its servicing, inspection, repairs, etc. to be done with great ease and high efficiency as well as quickly and accurately, thus facilitating to maintain the performance of the apparatus.

Also, the separate connections of the developer container and the developing electrode portion contribute to the ease with which the developing device is handled, serviced, inspected, repaired or otherwise treated.

In the developing device constructed as described above, when the apparatus is not in operation or when the motor 224 is not rotating, the developing liquid 222 in the container 221 maintains the liquid level $L_1$. As a result, the filter 223 is fully immersed in the developing liquid 222 so that the filter 223 is prevented from clogging which would otherwise result from solidification and deposition of toner on the filter due to evaporation of the developing liquid. Next, when the apparatus is operated, the motor 224 revolves in the direction of arrow so that the developing liquid is drawn into the casting 226 by the impeller 225 and passed through the outlet 227 and the conduit 228 into the developing electrode 229, and impinges on the projected end 242, whereby the flow velocity of the developing liquid is reduced. Then, the liquid slowly discharges through the opening 243 extending lengthwise of the photosensitive drum 231 and fills the slight clearance *l* between the drum 231 and the developing electrode 229 to develop the electrostatic latent image on the photosensitive drum 231. The developing liquid overflown from the developing electrode 229 is received in the dish 233 and flows down along the sloped surface of the dish to concentrate in the opening 234, from which the liquid falls through the drain pipe 235 while being given an energy by the head H, and strikes against the filter member 223 in the developer container 221. With the start of the apparatus, the developing liquid 222 begins to circulate through various parts so that the liquid level in the developer container 221 is gradually decreased to a predetermined level $L_2$. In such state, the filter member 223 emerges fully out of the liquid and struck by the falling developing liquid given a sufficient energy by the head H. Thus, any solidified toner masses are again dispersed and the toner masses or dust may be prevented from sticking to the filter member, which can thus perform its filtrating function sufficiently. The developing liquid 222 passed through the filter member forms a rapid flow in the developer container 221 and flows into a pumping portion to prevent precipitation of toner, while the rapid flow is again useful to provide a sufficient agitating effect. It will be noted that the developing liquid which falls onto the filter member 223 strikes against the sloped surface portion 297 of the filter member 223 to force dust or other impurities from such sloped surface portion 297 to the flat surface portion 298 for accumulation thereon. The filter member may be removably mounted to facilitate its replacement or cleaning.

In other words, the construction is such that a member for dispersing toner masses is interposed between the developing portion and the liquid container of the liquid developing device so as to permit the developing liquid to circulate through said member. This enables any toner masses created in the developing liquid to be re-dispersed by said member to provide sufficiently filtrated and mixed developing liquid. In the illustrated embodiment of the apparatus, if the apparatus remains inoperative for a long time, the developing liquid on the developing electrode 229 and the dish 233 will evaporate and the toner in the liquid will solidify to form relatively large masses. When the apparatus resumes its operation, these relatively large masses of toner will be washed away by and mixed with the developing liquid, but the toner masses will pass through the drain pipe 235 to strike against the dispersing member and be finely crushed thereby, with a result that no large toner mass will be contained in the liquid supplied to the developing portion A. Further, any large toner masses captured by said member will be finely crushed due to the continuous fall of the developing liquid. Thus, according to the present invention, any toner masses may be finely crushed and redispersed and the filtration of the developing liquid may be fully accomplished, thereby eliminating such disadvantages as unevenness of the resultant copy images and injuries imparted to the photosensitive medium.

Although the foregoing has been described with respect to an electrophotographic copying apparatus using a photosensitive medium, it will be obvious that the invention is also applicable to copying machines of the fax type which use sensitive paper.

Figure 13:
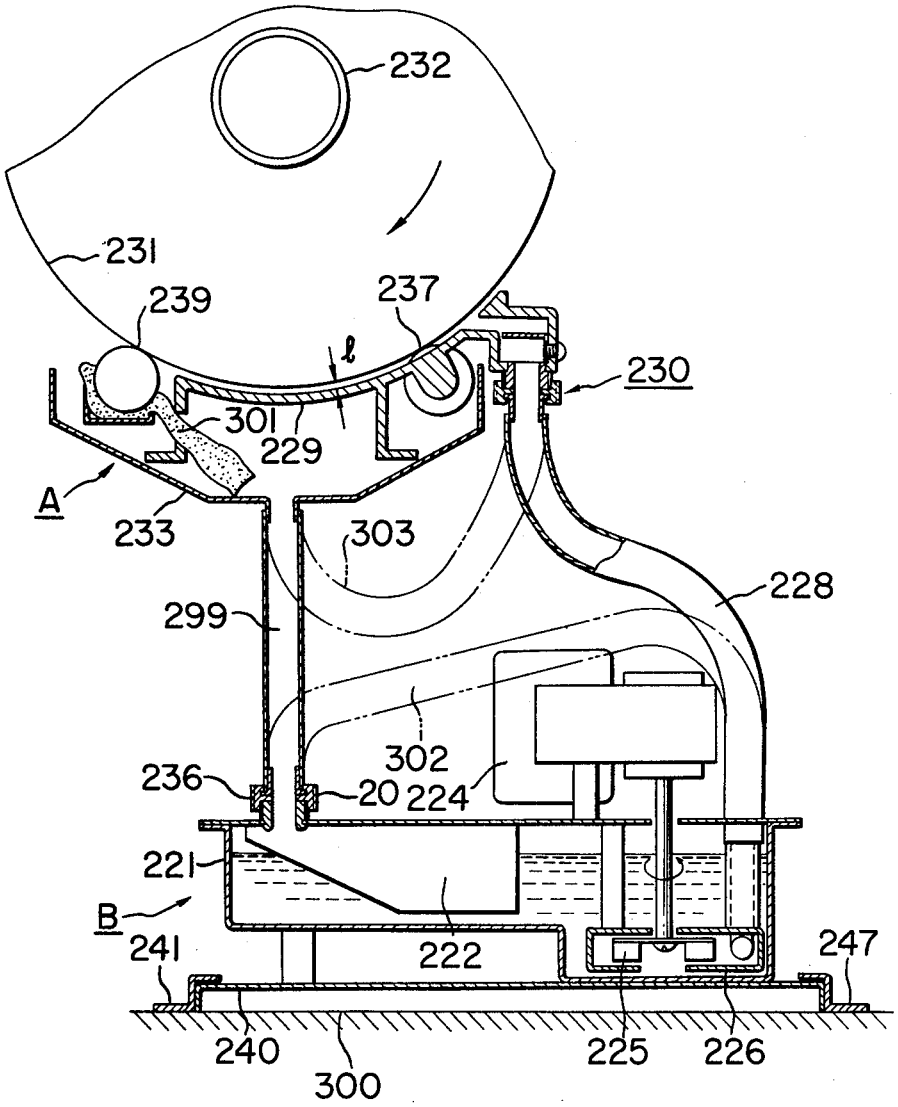
FIG. 13 shows another embodiment of the developing device.

Referring now to FIG. 13, the photosensitive drum 231 is surrounded by various means for forming an electrostatic latent image corresponding to the image of an original and means (not shown) for transferring the image, developed by developing portion, to transfer paper. The developing device for developing the electrostatic latent image into a visible image comprises individually constructed developing portion A and developer container portion B, which are connected together by a supply pipe 228 and collection pipe 229.

The developing liquid 222 in the container 221 forming the container portion B is drawn into the casing 226 by the impeller 225 rotated by the motor 224, and is delivered to the developing portion A through the supply pipe 228. The developing liquid is then directed to the developing electrode 229 forming the developing portion A, to thereby develop the electrostatic latent image on the photosensitive drum 231 into a visible image. The developing liquid 222, which has thus been used for the development of the electrostatic latent image, is collected in the dish 233 and falls into the container 221 through the collection pipe 299. Further, the angles 241 and 247 secured to the copying apparatus body 300 at the bottom of the container 221 of the developing liquid container portion B are engaged with the angle 240 secured to the bottom of the container 221 and are capable of moving the container 221 in the direction perpendicular to the plane of the drawing sheet. The developing portion A is designed (not shown) such that the roller 230 is normally in contact with the outer periphery of the photosensitive drum 231 to maintain a clearance *l* between the drum 231 and the developing electrode 229 and that the outer periphery of the photosensitive drum 231 and the roller 237 may be brought out of contact with each other either by depressing the developing portion A or by raising the photosensitive drum 231, to thereby permit removal of the developing portion in the direction perpendicular to the plane of the drawing sheet. The developing portion A also includes a roll 239 effective to prevent fogging of the visualized image on the photosensitive drum 231, and a cleaning member 301 for the roll 239. Removable connectors 230 and 236 are provided on one end of the supply and collection pipes 228 and 299 each, and the removability of these connectors 230 and 236 is utilized to connect the pipes 228 and 299 in the manner as indicated by dots-and-dash lines, so as to provide independent circulation paths 302 and 303 for the developing portion A and the developer container portion B, respectively.

Figure 14:
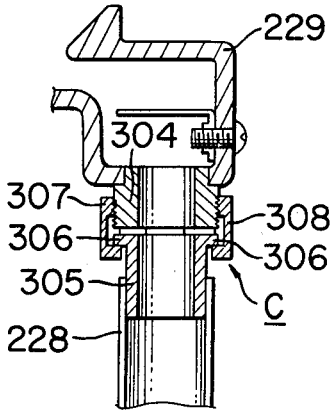
FIG. 14 illustrates the construction of the connector portion in the embodiment of FIG. 21.

An example of the construction of the above-described connector 230 will now be described in connection with FIG. 14. As shown, a connecting member 304 is fixedly secured to the developing electrode 229 as by screws or adhesive, and a connecting member 305 is also fixedly secured to the supply pipe 228. The connecting member 305 has a coupling nut 307 engaged with a projection 306, which coupling nut 307 is internally threaded for mesh engagement with the external threads formed on the outer periphery of the connecting member 304, with a result that the supply pipe 228 is communicated with the developing portion A. An anti-leakage rubber packing 308 is interposed between the two connecting members 304 and 305. Another connector portion 236 shown in FIG. 13 is similar in construction and size to the connector 230 and so, as indicated by the dots-and-dash lines in FIG. 13, the collection pipe 299 of the developing portion A is connectible to the supply port of the portion A and the supply port 228 is connectible to the collection port of the developer container. These pipes, which thus provide connection between the developing portion and the developer container portion, are designed to provide circulation paths in the individual portions, whereby these pipes will neither interfere with the removal of the developing portion A or the container portion B nor permit leakage of the developing liquid. Further, in the developer container portion B, the provision of the independent circulation path leads to the possibility of the trial operation of the container portion B.

Figure 15:
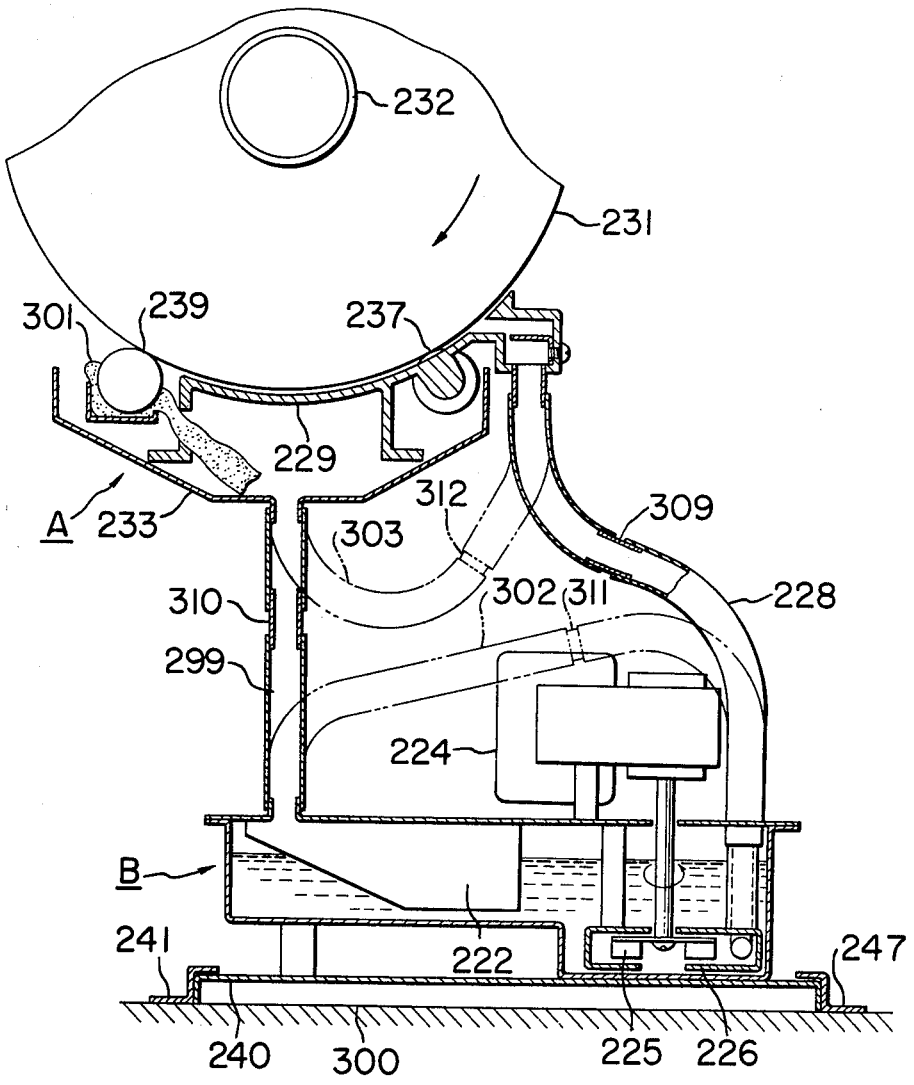
FIG. 15 shows still another embodiment of the developing device.

FIG. 15 shows a simple embodiment of the present invention. In this embodiment, as shown, the supply pipe 228 and the collection pipe 299 connecting the developing portion A and the developer container portion B are each divided into two parts, and these respective two parts are further connected together by a connecting pipe 309 or 310. In such construction, by removing the connecting pipe 309 and 310 from the supply pipe 228 and the collection pipe 299, the supply pipe 228 connected to the developing portion A and the collection pipe 299 connected to the container portion B may be connected together through a connecting pipe 309 (or 310) to provide an independent circulation path in the developer container portion B. Further, the supply pipe 228 and the collection pipe 229 connected to the developing portion A may be connected through a connection pipe 310 (or 311) to provide an independent circulation path in the portion A. The embodiment of FIG. 23 can also achieve the effect as described in connection with the embodiment of FIG. 13 and in addition, can provide the circulation paths more simply and readily than the embodiment of FIG. 13. In FIG. 15, the parts similar to those in FIG. 13 are given similar reference numerals.

According to this embodiment of the present invention, as will be appreciated, the means for connecting the developing portion for developing the electrostatic latent image to the container portion for containing the developing liquid to be supplied to the developing portion are connected so as to provide an independent circulation path in each of the two portions. With such construction, the developing portion or the developer containing portion may be removed from the apparatus body without being interfered with by the pipes and without the possibility of the developing liquid leaking from the developing portion or the container portion. Furthermore, the provision of independent circulation paths permits the trial operation of the container portion to be effected.

It is to be noted that the supply pipe or the collection pipe, when one end or a part thereof has been removed to make the container portion and the developing portion independent from each other, may be fixed by hook or like means so as to prevent outward leakage of the developing liquid. Although the above embodiment has been illustrated with respect to a developing device in the electrophotographic art using a photosensitive medium, it will be apparent that the embodiment is applicable to other developing devices such as mist developing device or diazo developing device.

Figure 16:
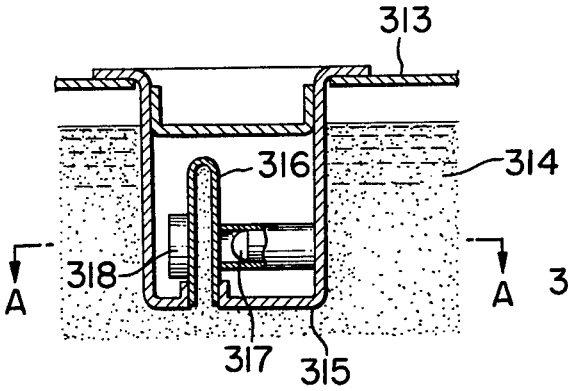
FIG. 16 is a longitudinal cross-section of the density detector device according to the prior art.
Figure 17:
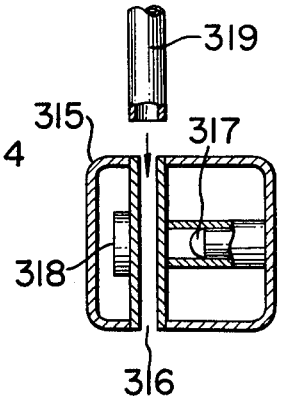
FIG. 17 is a cross-section taken along line A—A of FIG. 16.

Referring to FIG. 16, a small density detector chamber 315 is defined in developing liquid 314 within a developer container 313 and a passage 316 is formed of glass or like transparent material and extends vertically in the chamber so that part of the developing liquid to be supplied to the developing portion may be directed from an unshown pump through a conduit 319 into the passage 316. A light source 317 and a light-sensing element 318, which together form a photoelectric detector means, are disposed on the opposite sides of the passage 316 in the chamber. Even during inoperative condition of the copying apparatus, the passage 316 of transparent material is filled with developing liquid so that toner will never stick to the wall portion of the passage 316 which corresponds to the optical path. Since the developing liquid as injected from the conduit 319 is at a predetermined flow velocity, such liquid will flow through the passage 316 while diverging into a sector form. This will prevent toner from sticking to the inner wall portion of the passage 316 which is exposed to the flow of developing liquid, but the rest of the passage wall will suffer from sticking of toner. In other words, unless the light source 317 and the light-sensing element 318 were disposed at locations corresponding to the area of the passage in which the developing liquid 314 flows in a sector form, no proper density of the developing liquid will be obtained and this would necessarily lead to an increased size of the passage 316. In order that the developing liquid 314 may be directed through the conduit 319, the pumping force must be increased, otherwise the flow velocity of the developing liquid 314 would be reduced to cause toner to stick to the wall of the passage 316.

Description will further be made of a construction wherein a pumping mechanism including an impeller and a casing forming a spiral chamber is provided in developing liquid and a portion of the casing is formed with a slit-like or other opening through which the developing liquid may be directly passed to the passage in the photoelectric detector means.

Figure 18:
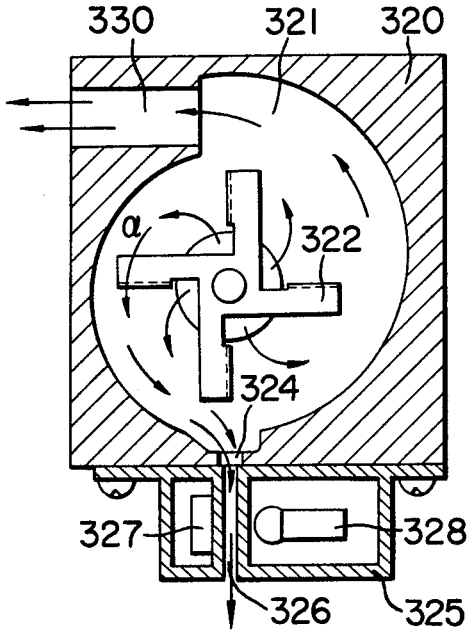
FIG. 18 illustrates the construction of an embodiment of the density detector device.
Figure 19:
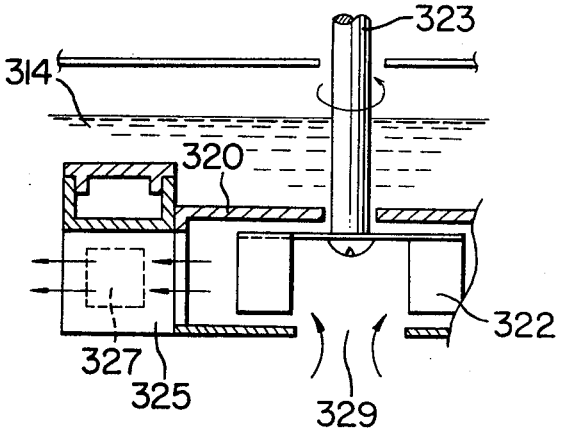
FIG. 19 is a cross-section of the FIG. 18 embodiment taken along the impeller and the slit-like opening.
Figure 20:
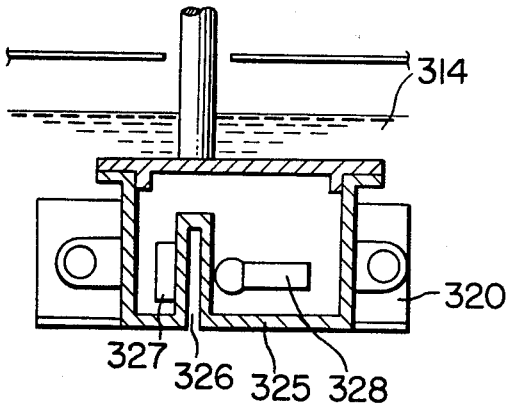
FIG. 20 is a cross-section of the photoelectric detector portion in the FIG. 18 embodiment and showing such detector portion and the slit portion.

Referring to FIGS. 18, 19 and 20, a casing 320 forming a pump defines a spiral chamber 321 therewithin and accommodates therein an impeller 322 rotatable in the direction of arrow. The impeller 322 is directly connected to a motor shaft 323. A portion of the casing 320 is formed with a slit 324 as opening. A density detector chamber 325 accommodating therein a light source 328 and light-sensing element 327 for detecting the density of the developing liquid 314 is provided with a passage 326 formed of glass, transparent plastics or other transparent material. The passage 326 is attached to the casing 320 for engagement with the slit 324 formed in the casing 320.

In the developing liquid density detector device constructed as described, the developing liquid 314 is drawn in through the liquid intake port 329 of the case 320 by rotation of the impeller in the direction of arrow $\alpha$ and the pressure of the drawn liquid is increased in the spiral chamber 321 to increase its flow velocity, and then the liquid is delivered through the opening 330 to the developing portion (not shown) for developing an electrostatic latent image. Likewise, the developing liquid 314 is also injected rapidly through the slit 324 to the passage 326 in the photoelectric detector means.

Since the developing liquid injected from the spiral chamber 321 is delivered through the slit 324 to the passage 326 in the photoelectric detector means while keeping a great width of flow but without the flow velocity thereof being reduced, toner will never stick to the transparent wall portion of the passage 326. Even if toner should stick to the wall portion of the passage 326 during down-time of the copying apparatus, such toner may readily be removed by the developing liquid rapidly flowing out of the slit 324, thus ensuring proper density detection of the developing liquid to be achieved. In addition, the developing liquid 314 flows out at a high velocity in accordance with the shape of the slit 324, and this enables the size of the detector chamber 325 to be minimized.

To maintain the developing liquid at a constant density by the use of the above-described density detector device, use may be made of an electric circuit for operating a toner supply valve by a signal from, for example, the light-sensing element 326 and light source 328 forming the photoelectric detector means. More specifically, a switching transistor may be operated by the voltage at the junction between the resistance of the light-sensing element 327 and a regulating resistance to permit a current to flow to an electromagnetic solenoid to operate the valve.

We claim:

1. In a machine embodying a liquid developing device, the improvement comprising:

a member for bearing thereon a latent image;

means disposed in opposition to said image bearing member for applying developer liquid thereto;

a container disposed at a lower position than said developer liquid applying means for holding developer liquid to be applied to said latent image bearing member;

means for circulating the developer liquid from said container to said developer liquid applying means and back into said container; and filter means disposed at a position where the developer liquid flows back into said container, said filter means having a developer liquid impinging portion which is angularly disposed with respect to said flow of the developer liquid and is disposed above the surface of the developer liquid contained in said container during the operation of said device, and a toner accumulating portion which is immersed in the developer liquid in said container at least when said pump means is not in operation to thereby soften and disperse any coagulated toner particles from the developer liquid accumulated thereon.

2. A device according to claim 1, wherein said filter means includes a net member having fine openings.

3. A device according to claim 2, wherein said angularly disposed portion forms a first part of said net member, and wherein said accumulating portion forms a second part of said net member.

4. A device according to claim 1, wherein said latent image bearing member includes a drum arranged substantially at a central portion of the machine, and said container is disposed at a lower portion of the machine.

5. In a machine embodying a liquid developing device, the improvement comprising:

a member for bearing thereon a latent image;

means disposed in opposition to said image bearing member for applying developer liquid thereto;

a container for holding developer liquid to be applied to said latent image bearing member and having pump means disposed therein;

supply pipe means for supplying the developer liquid to said developer liquid applying means from said container, said supply pipe means having an end coupled to said pump means and an end coupled to said developer liquid applying means, at least one of said two ends being coupled releasably;

return pipe means for returning the developer liquid from said developer liquid applying means to said container, said return pipe means having an end coupled to said developer liquid applying means and an end coupled to said container, at least one of said two ends of said return pipe means being coupled releasably, wherein at least one of said container and said developer liquid applying means is releasably mounted on the machine and is removable therefrom by uncoupling the releasable ends of said supply and return pipe means; and filter means disposed at a position where the developer liquid returning through said return pipe means flows into said container, said filter means having a developer liquid impinging portion which is angularly disposed with respect to said flow of the developer liquid and is disposed above the surface of the developer liquid container in said container during the operation of said pump means, and a toner accumulating portion which is immersed in the developer liquid in said container at least when said pump means is not in operation to thereby soften and disperse any coagulated toner particles from the developer liquid accumulated thereon.

6. A device according to claim 5, wherein said latent image bearing member includes a rotatable drum, and said developer liquid applying means includes a developing electrode opposed to a surface of said rotatable drum.

7. A device according to claim 5, wherein said latent image bearing member is disposed substantially at the center of the machine and said container is below said latent image bearing member.

8. A device according to claim 7, wherein said image bearing member includes a photosensitive drum.

9. A device according to claim 5, wherein said pump means includes a vane wheel and a wall member disposed therearound, said wall member being provided with a slit passage, and said device further comprising a developer liquid concentration detecting means disposed adjacent an outlet portion of said slit passage.

10. In a machine embodying a liquid developing device, the improvement comprising:

a member for bearing thereon a latent image;

means disposed in opposition to said image bearing member for applying developer liquid thereto;

a container for holding developer liquid to be applied to said latent image bearing member and having pump means disposed therein;

supply pipe means for supplying the developer liquid to said developer liquid applying means from said container, said supply pipe means having an end coupled to said pump means, an end coupled to said developer liquid applying means, and a disconnectable portion intermediate said two ends;

return pipe means for returning the developer liquid from said developer liquid applying means to said container, said return pipe means having an end coupled to said developer liquid applying means, an end coupled to said container, and a disconnectable portion intermediate said two ends, wherein at least one of said container and said developer liquid applying means is releasably mounted on the machine and is removable therefrom by disconnecting the disconnectable portions of said supply and return pipe means; and filter means disposed at a position where the developer liquid returning through said return pipe means flows into said container, said filter means having a developer liquid impinging portion which is angularly disposed with respect to said flow of the developer liquid and is disposed above the surface of the developer liquid contained in said container during the operation of said pump means, and a toner accumulating portion which is immersed in the developer liquid in said container at least when said pump means is not in operation to thereby soften and disperse any coagulated toner particles from the developer liquid accumulated thereon.

11. In a machine embodying a liquid developing device, the improvement comprising:

a member for bearing thereon a latent image;

means disposed in opposition to said image bearing member for applying developer liquid thereto;

a container for holding developer liquid to be applied to said latent image bearing member and having pump means disposed therein;

supply pipe means for supplying the developer liquid to said developer liquid applying means from said container, said supply pipe means having an end coupled to said pump means and an end coupled to said developer liquid applying means, at least one of said two ends being coupled releasably;

return pipe means for returning the developer liquid from said developer liquid applying means to said container, said return pipe means having an end coupled to said developer liquid applying means and an end coupled to said container, at least one of said two ends of said return pipe means being coupled releasably, wherein one of said supply pipe means and said return pipe means has its releasably coupled end coupled to said developer applying means, and the other of said pipe means has its releasably coupled end coupled to said container, and wherein said one pipe means has a length sufficient to permit its releasable end to be coupled to said container at the position of the releasable coupling of the other said pipe means when said other said pipe means is removed from its said position, whereby a circulation line is formed through said pump means, said one pipe means and said container; and filter means disposed at a position where the developer liquid returning through said return pipe means flows into said container, said filter means having a developer liquid impinging portion which is angularly disposed with respect to said flow of the developer liquid and is disposed above the surface of the developer liquid contained in said container during the operation of said pump means, and a toner accumulating portion which is immersed in the developer liquid in said container at least when said pump means is not in operation to thereby soften and disperse any coagulated toner particles from the developer liquid accumulated thereon.

12. A device according to claim 11, wherein the other said pipe means has a length sufficient to permit its releasable end to be coupled to said developer applying means at the position of the releasable coupling of said one pipe means when said one pipe means is removed from its said position, whereby said other pipe means can be connected at both ends to said developer applying means.

13. A device according to claim 11, wherein said one of the pipe means is said supply pipe means.

14. A device according to claim 11, wherein said container is releasably mounted on the machine and is removable therefrom upon releasing said releasable couplings of said respective pipe means.

15. In a machine embodying a liquid developing device, the improvement comprising:

a rotatable drum for bearing thereon a latent image;

means including a developer electrode disposed in opposition to said image bearing drum for applying developer liquid thereto;

a container for holding developer liquid to be applied to said latent image bearing drum and having pump means disposed therein;

supply pipe means for supplying the developer liquid to said developer liquid applying means from said container, said supply pipe means having an end coupled to said pump means and an end releasably coupled to said developer liquid applying means;

return pipe means for returning the developer liquid from said developer liquid applying means to said container, said return pipe means having an end coupled to said developer liquid applying means and an end releasably coupled to said container, wherein said supply pipe means has a length sufficient to permit its releasable end to be coupled to said container at the position of the releasable coupling of said return pipe means when said return pipe means is removed therefrom, and wherein said return pipe means has a length sufficient to permit its releasable end to be coupled to said developer applying means at the position of the releasable coupling of said supply pipe means when said supply pipe means is removed therefrom, and whereby one of said container and said developer applying means is removable from the machine; and filter means disposed at a position where the developer liquid returning through said return pipe means flows into said container, said filter means having a developer liquid impinging portion which is angularly disposed with respect to said flow of developer liquid and is disposed above the surface of the developer liquid contained in said container during the operation of said pump means, and a toner accumulating portion which is immersed in the developer liquid in said container at least when said pump means is not in operation to thereby soften and disperse any coagulated toner particles from the developer liquid accumulated thereon.

16. In a machine embodying a liquid developing device, the improvement comprising:

a member for bearing thereon a latent image;

means disposed in opposition to said image bearing member for applying developer liquid thereto;

a container disposed at a lower position than said developer liquid applying means for holding developer liquid to be applied to said image bearing member;

means for circulating the developer liquid from said container to said developer liquid applying means and back into said container;

pump means immersed within the developer liquid in the container, said pump means including a vane wheel and a wall member disposed therearound;

said wall member defining a slit passage within the developer liquid in the container to allow the outlet flow of the developer liquid from the vane wheel;

filter means disposed at a position where the developer liquid flows back into said container, said filter means having a developer liquid impinging portion which is angularly disposed with respect to said flow of the developer liquid and is disposed above the surface of the developer liquid contained in said container during operation of said pump means, and a toner accumulating portion which is immersed in the developer liquid in said container at least when said pump means is not in operation to thereby soften and disperse any coagulated toner particles from the developer liquid accumulated thereon; and means for detecting a concentration of the developer liquid, said detecting means being disposed adjacent an outlet portion of the slit passage to detect a concentration of the developer liquid which flows through said slit passage.

* * * * *

UNITED STATES PATENT OFFICE

CERTIFICATE OF CORRECTION

Patent No. 4,110,029 Dated August 29, 1978

Inventor(s) YOSHITOMO GOSHIMA, ET AL

It is certified that error appears in the above-identified patent and that said Letters Patent are hereby corrected as shown below:

Column 2, line 31, "electrode on" should read --electrode portion--;

Column 2, line 45, "." should read --,--;

Column 2, line 46, "hereof" should read --thereof--;

Column 6, lines 35 and 36, "developing" should read --developer--;

Column 7, line 50, "plate 235" should read --plate 255--;

Column 8, line 57, "the stops" should read --and stops--;

Column 9, line 18, "whih" should read --which--;

Column 9, line 56, "casting" should read --casing--;

UNITED STATES PATENT OFFICE

CERTIFICATE OF CORRECTION

Patent No. 4,110,029 Dated August 29, 1978

Inventor(s) YOSHITOMO GOSHIMA, ET AL

It is certified that error appears in the above-identified patent and that said Letters Patent are hereby corrected as shown below:

Column 10, line 68, "pipe 229" should read --pipe 299--;

Column 15, line 7, "container" should read --contained--.

Signed and Sealed this

Tenth Day of July 1979

[SEAL]

Attest:

Attesting Officer

LUTRELLE F. PARKER

Acting Commissioner of Patents and Trademarks